US005251245A

United States Patent [19]

Evans et al.

[11] Patent Number: 5,251,245

[45] Date of Patent: Oct. 5, 1993

[54] SHIELDED ACCESS DOOR FOR A NUCLEAR STEAM GENERATOR MANWAY PORT HAVING A BEAM OF RADIATION STREAMING THERETHROUGH

[75] Inventors: David M. Evans; Ricky L. Tucker, both of Spartanburg, S.C.; John O. Izzo, Pittsburgh, Pa.

[73] Assignee: Westinghouse Electric Corp., Pittsburgh, Pa.

[21] Appl. No.: 943,954

[22] Filed: Sep. 11, 1992

[51] Int. Cl.[5] ..... G21C 11/02

[52] U.S. Cl. ..... 376/287; 376/203; 250/515.1

[58] Field of Search ..... 376/203, 287; 250/515.1

[56] References Cited

U.S. PATENT DOCUMENTS

| | | | |
|---|---|---|---|
| 4,079,701 | 3/1978 | Hickman et al. | 122/382 |
| 4,729,869 | 3/1988 | Schukei et al. | 376/287 |
| 4,801,423 | 1/1989 | Warren et al. | 376/287 |
| 4,833,335 | 5/1989 | McGinley et al. | 250/518.1 |
| 4,932,553 | 6/1990 | Reich, Jr. et al. | 376/287 |
| 4,948,981 | 8/1990 | Wallace et al. | 376/272 |

*Primary Examiner*—Donald P. Walsh
*Assistant Examiner*—Frederick H. Voss
*Attorney, Agent, or Firm*—Walter S. Stevens

[57] ABSTRACT

A shielded access door for a nuclear steam generator manway port having a beam of radiation streaming therethrough, the port being surrounded by a manway flange. The door comprises a bracket adapted to be removably connected to the flange. A plurality of swing arms have the first end portion thereof pivotally connected to the bracket. A first shield member is connected to the second end portions of the arms and is disposed parallel and adjacent to the port for shielding against the beam of radiation. The first shield member and the port define a gap therebetween for allowing access to the steam generator interiorly of the port while simultaneously shielding against the beam of radiation. The first shield member has a ventilation hole therethrough in communication with the port for ventilating the port, so that air-borne radioactive particles present interiorly of the steam generator are exhausted from the steam generator. A second shield member, which is attached to the first shield member, is coaxially aligned with the hole of the first shield member and is spaced-apart from the first shield member for preventing the beam of radiation from exiting through the ventilation hole. The second shield member is capable of being interposed between the beam of radiation and the hole for shielding the hole against the beam of radiation. Moreover, the first shield member is formed of light weight connectable segments to facilitate lifting and positioning of the door at the manway port.

10 Claims, 6 Drawing Sheets

SHIELDED ACCESS DOOR FOR A NUCLEAR STEAM GENERATOR MANWAY PORT HAVING A BEAM OF RADIATION STREAMING THERETHROUGH

BACKGROUND

This invention generally relates to closures for openings and more particularly relates to a shielded access door for a nuclear steam generator manway port having a beam of radiation streaming therethrough.

Although devices for covering nuclear steam generator manways during maintenance operations are known, it has been observed by applicant that these devices have a number of operational problems associated with them. However, before these problems can be appreciated, some background is necessary as to the structure and operation of a typical nuclear steam generator.

In this regard, a typical nuclear heat exchanger or steam generator generates steam when heat is transferred from a heated and radioactive primary fluid (i.e., water) to a non-radioactive secondary fluid (i.e., also water) of lower temperature. The primary fluid flows through a plurality of inverted U-shaped tubes, which are received through holes in a plurality of spaced-apart support plates while the ends of each tube are received in a tubesheet disposed below the bottom-most support plate. The interior of the steam generator below the tubesheet (i.e., the channel head) in combination with the interior of the tubes define a radioactive primary side of the steam generator while the interior of the steam generator above the tubesheet defines a nonradioactive secondary side of the steam generator.

During operation of the steam generator, the secondary fluid flows across the exterior surfaces of the tubes as the primary fluid flows through the tubes. The walls of the tubes function as heat conductors for transferring heat from the heated primary fluid flowing through the tubes to the secondary fluid of lower temperature flowing across the exterior surfaces of the tubes. Thus, the tubesheet and the U-shaped tubes hydraulically isolate the primary side from the secondary side of the steam generator while thermally connecting them together. The steam generator also includes a plurality of circular manway openings in communication with the channel head for allowing access to the interior of the steam generator in order to perform maintenance on the steam generator, which manways are sealingly covered by manway hatch covers during operation of the steam generator. Surrounding each manway is a manway flange to which the hatch cover is sealingly bolted.

For safety reasons, the tubes are designed to be leak-tight so that the radioactive primary fluid remains separated from the nonradioactive secondary fluid to avoid commingling the primary fluid with the secondary fluid. Occasionally, however, the steam generator tubes may degrade due to stress and corrosion occurring during operation and thus may not remain leak-tight. This is undesirable for safety and economic reasons.

Therefore, during maintenance of the steam generator, the steam generator is taken off-line and the tubes are inspected for degradation using various inspection devices, such as eddy current or ultrasonic probes inserted into the tubes. These probes travel along the inside surface of the tube for inspecting the tube. However, if the inner surface of the tube is not sufficiently dry during the inspection process, the probe may slip on the wet inner surface of the tube due to lack of traction, which slippage can lead to inaccurate instrument readings. Therefore, it is important that the inner surface of the tube is sufficiently dry to satisfactorily perform the inspection process. Moreover, the maintenance process may also include removing radioactive sludge deposits and other particulate matter from the interior surfaces of the steam generator because such sludge and particulate matter may damage the tubes during operation. However, the sludge removal processes may increase the amount of any air-borne radioactive micro-particles that may be already suspended in the atmosphere inside the steam generator. These air-borne radioactive particles are preferably exhausted from the steam generator before maintenance personnel service the steam generator in order to reduce radiation exposure to the maintenance personnel. Exhausting the air-borne radioactive particles from the steam generator is important because such particles can adhere to the clothing of maintenance personnel, thereby resulting in a need to expend more effort and expense to decontaminate the clothing worn by the maintenance personnel.

Of course, before the maintenance process is begun, the primary and secondary fluids are drained and the manway hatch covers covering the steam generator manways are removed for allowing access to the steam generator interior. However, because the interior of the steam generator is radioactive, a beam of radiation "shines" or streams through the manway when the manway hatch cover is removed. This beam of radiation may have an intensity of approximately seven thousand mR (i.e., milliroentgen) at the manway. Exposing maintenance personnel to such a radiation level for prolonged time periods is undesirable for health physics reasons. Therefore, shielding covers have been used in the art to suitably cover the manway for reducing the radiation emissions in order to protect maintenance personnel from the radiation as they service the steam generator.

However, manway shielding covers are relatively heavy because the shielding material comprising the cover is usually made of a metal of relatively high mass number, such as lead or the like, in order to provide sufficient shielding. Such covers may attain a weight of approximately 60 pounds or more. The heavy weight of the covers inhibits the ability of maintenance personnel to readily lift and position the covers over the manway. Therefore, a problem in the art is to provide a manway cover that is light weight so that it can be readily lifted and positioned to cover the manway.

Moreover, a well known characteristic of lead is that it is relatively soft or malleable. Therefore, the surface of the lead covers are easily dented in use and hence are not usually smooth. The rough or dented surface of such lead covers provides sites for accumulation of the air-borne radioactive particulate matter that may be suspended in the atmosphere of the interior of the steam generator. This accumulation of radioactive particulate matter on the surface of the lead covers requires greater effort and expense to decontaminate the covers following steam generator maintenance. Therefore, another problem in the art to provide a manway cover that can be readily decontaminated.

In addition, insulation may surround the exterior surface of the steam generator for inhibiting heat loss from the exterior surface of the steam generator. This heat loss is undesirable because it results in a reduction in the thermal efficiency of the steam generator. Such insulation typically results in approximately a six to eight inch interference extending outwardly from the face of the manway flange. This interference requires a portion of the insulation surrounding the manway flange to be removed in order to provide space to position the shielding cover over the manway. Therefore, yet another problem in the art is to provide a shielding cover that does not require a portion of the insulation surrounding the manway flange to be removed in order to position the shielding cover over the manway.

Shielding and exhaust covers for nuclear steam generator manways are known. A shielding cover and an exhaust cover which are mountable on the primary manways of a nuclear steam generator for protecting maintenance personnel from potentially harmful radiation during maintenance operations is disclosed in U.S. Pat. No. 4,948,981 titled "Primary Manway Shielding And Exhaust Covers For A Steam Generator" issued Aug. 14, 1990 in the name of Wayne R. Wallace, et al. and assigned to the assignee of the present invention. This patent discloses shielding and exhaust covers including interchangeable mounting flanges having brackets for mounting a dual rail track assembly. The shielding and exhaust covers are each adapted to readily receive the dual rail track so as to be slidably movable from an open position to a closed position, and to allow for ease in the initial positioning of the covers. The exhaust cover itself includes a central opening with a nozzle extending outwardly from the cover. A shielding plate is positioned on the inner side of the exhaust cover so as to allow air to pass therebetween and out of the nozzle. The mounting flange allows the shielding and exhaust covers to be interchanged on the same manways. Although this patent discloses a shielding and an exhaust cover mountable on the primary manways of a nuclear steam generator, this patent does not appear to disclose a shielding cover that allows access to the manway as it simultaneously shields against the radiation and therefore does not appear to disclose a suitable shielded access door for a port having a beam of radiation streaming therethrough, as described and claimed hereinbelow.

Therefore, what is needed is a shielded access door for a nuclear steam generator manway port having a beam of radiation streaming therethrough.

SUMMARY

Disclosed herein is a shielded access door for a nuclear steam generator manway port having a beam of radiation streaming therethrough, the port being surrounded by a manway flange. The door comprises a bracket adapted to be removably connected to the flange. A plurality of swing arms have the first end portion thereof pivotally connected to the bracket. A first shield member is connected to the second end portions of the arms and is disposed parallel and adjacent to the port for shielding against the beam of radiation. The first shield member and the port define a gap therebetween for allowing access to the steam generator interiorly of the port while simultaneously shielding against the beam of radiation. The first shield member has a ventilation hole therethrough in communication with the port for ventilating the port, so that air-borne radioactive particles present interiorly of the steam generator are exhausted from the steam generator. A second shield member, which is attached to the first shield member, is coaxially aligned with the hole of the first shield member and is spaced-apart from the first shield member for preventing the beam of radiation from exiting through the ventilation hole. The second shield member is capable of being interposed between the beam of radiation and the hole for shielding the hole against the beam of radiation. Moreover, the first shield member is formed of light weight connectable segments to facilitate lifting and positioning of the door at the manway port.

An object of the present invention is to provide a shielded access door for a nuclear steam generator manway port having a beam of radiation streaming therethrough.

Another object of the present invention is to provide a light-weight shielded access door for a nuclear steam generator manway port, so that the door can be readily lifted and manipulated by steam generator maintenance personnel.

Yet another object of the present invention is to provide a shielded access door for a nuclear steam generator manway port that can be readily decontaminated following servicing of the steam generator.

Still another object of the present invention is to provide a shielded access door for a nuclear steam generator manway port surrounded by a manway flange that is in turn surrounded by insulation extending beyond the flange such that the insulation impedes access to the port, such that use of the access door does not require removal of the insulation to position the access door over the port.

A further object of the present invention is to provide a shielded access door that permits the interior of the steam generator to be exhausted of air-borne radioactive particles.

A feature of the present invention is the provision of a an access door including a first shield plate having connectable segments such that each segment is lightweight to allow each segment to be readily lifted and positioned to cover the manway port.

Another feature of the present invention is the provision of a first shield plate having a ventilation hole therethrough for ventilating the interior of the steam generator.

Still another feature of the present invention is the provision of an access door including a second shield plate disposed opposite the hole of the first shield plate for shielding the hole against the beam of radiation.

Yet another feature of the present invention is the provision of a first and a second shield plate, each having a first layer laminated to a second layer, the first layer having an exterior surface resistant to accumulation of radioactive particles, so that the access door can be readily decontaminated.

Another feature of the present invention is the provision of an outwardly projecting bracket having the first and second shield plates connected thereto, the bracket being removably attached to a manway flange surrounding the manway port which in turn has insulation surrounding the flange so as to create an interference that impedes access to the port, the bracket extending beyond the insulation so that the insulation need not be removed to position the access door at the manway port.

An advantage of the present invention is that use of the access door reduces the time necessary to position the door at the manway port because the insulation need not be removed.

Another advantage of the present invention is that due to the light weight of the segments of the first shield plate, use of the access door requires less effort to lift and position the door at the manway port.

Yet another advantage of the present invention is that use of the access door reduces the radiation exposure to maintenance personnel because air-borne particulate matter suspended in the atmosphere interiorly of the steam generator is ventilated from the steam generator prior to servicing the steam generator.

These and other objects, features, and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing out and distinctly claiming the subject matter of the invention, it is believed the invention will be better understood from the following description taken in conjunction with the accompanying drawings wherein:

DESCRIPTION OF THE PREFERRED EMBODIMENT(S)

Nuclear steam generators routinely require maintenance to inspect and repair degraded steam generator tubes, to remove sludge deposits and to perform other maintenance activities. In order to perform this maintenance, the steam generator is taken off-line and the manway hatch covers are removed from the manways to gain access to the interior of the steam generator. However, once these hatch covers are removed, a beam of radiation "shines" or streams through the manway. Exposing maintenance personnel to such radiation is undesirable for health physics reasons. Therefore, it is prudent to deploy a shielding cover over the manway in order to suitably cover the manway to protect maintenance personnel from the radiation as they service the steam generator. Disclosed herein is a shielded access door for a nuclear steam generator manway port having a beam of radiation streaming therethrough, the access door being configured to protect the maintenance personnel from the beam of radiation.

However, before disclosing the subject matter of the present invention, it is instructive first to briefly describe the structure and operation of a typical nuclear steam generator.

Figure 1:
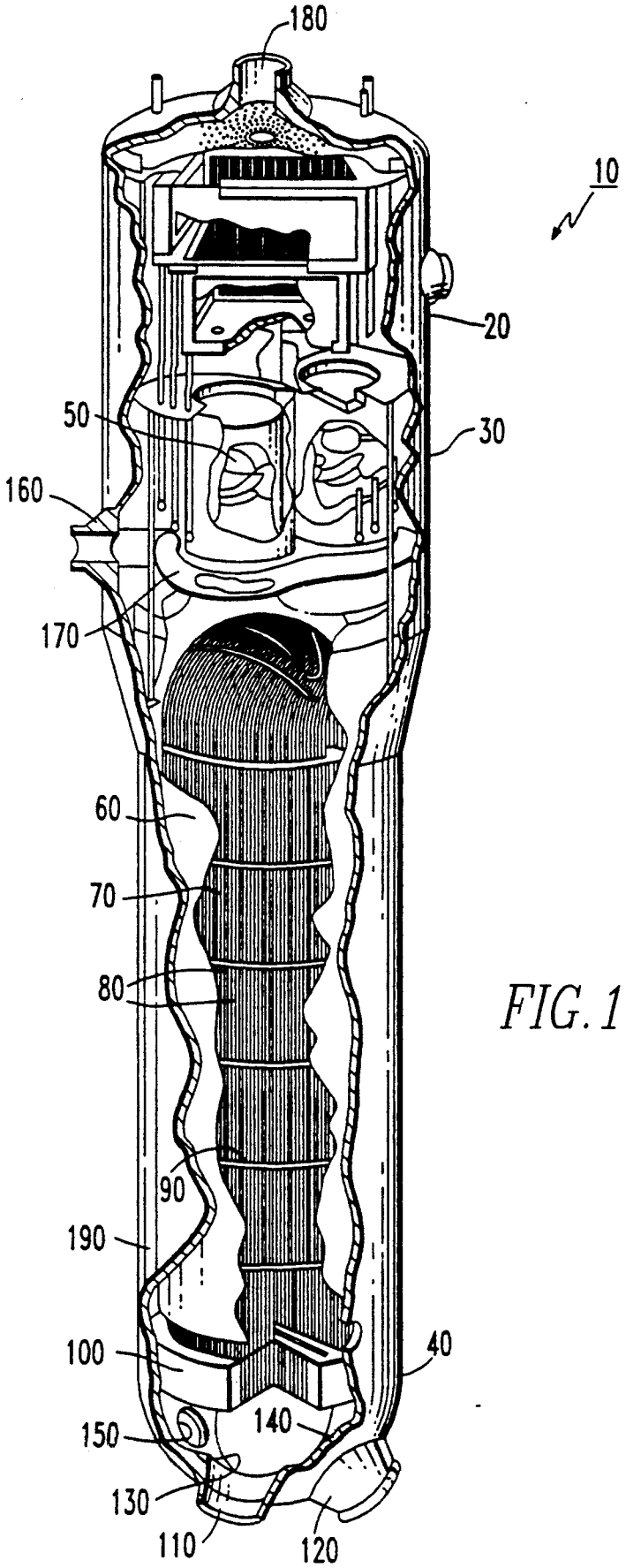
FIG. 1 is a perspective view in partial elevation of a typical nuclear steam generator with parts removed for clarity, the steam generator having a plurality of manway ports formed through a lower portion thereof.
Figure 2:
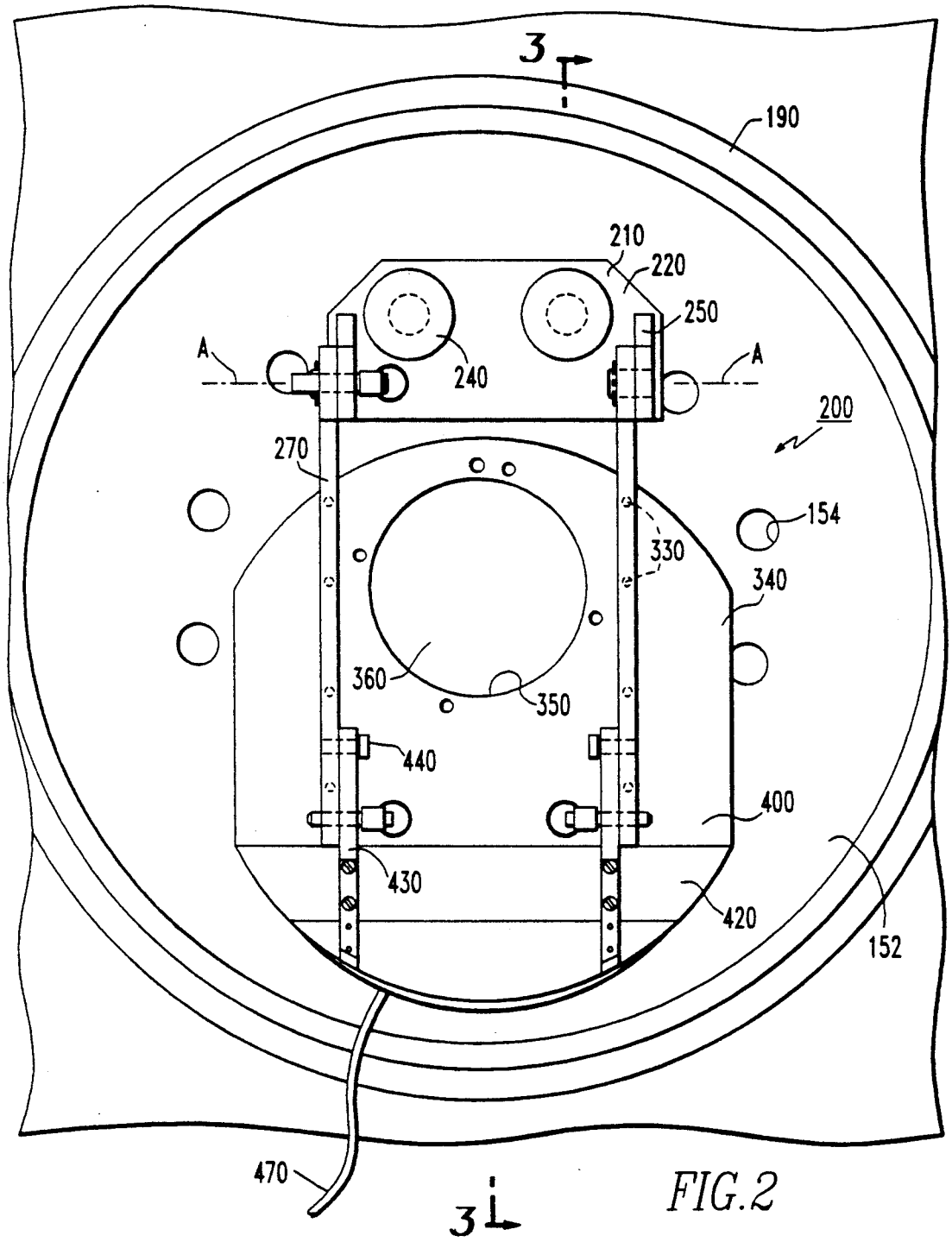
FIG. 2 is a view in elevation of an access door belonging to the invention and disposed over the port, the access door having a ventilation hole therethrough.
Figure 3:
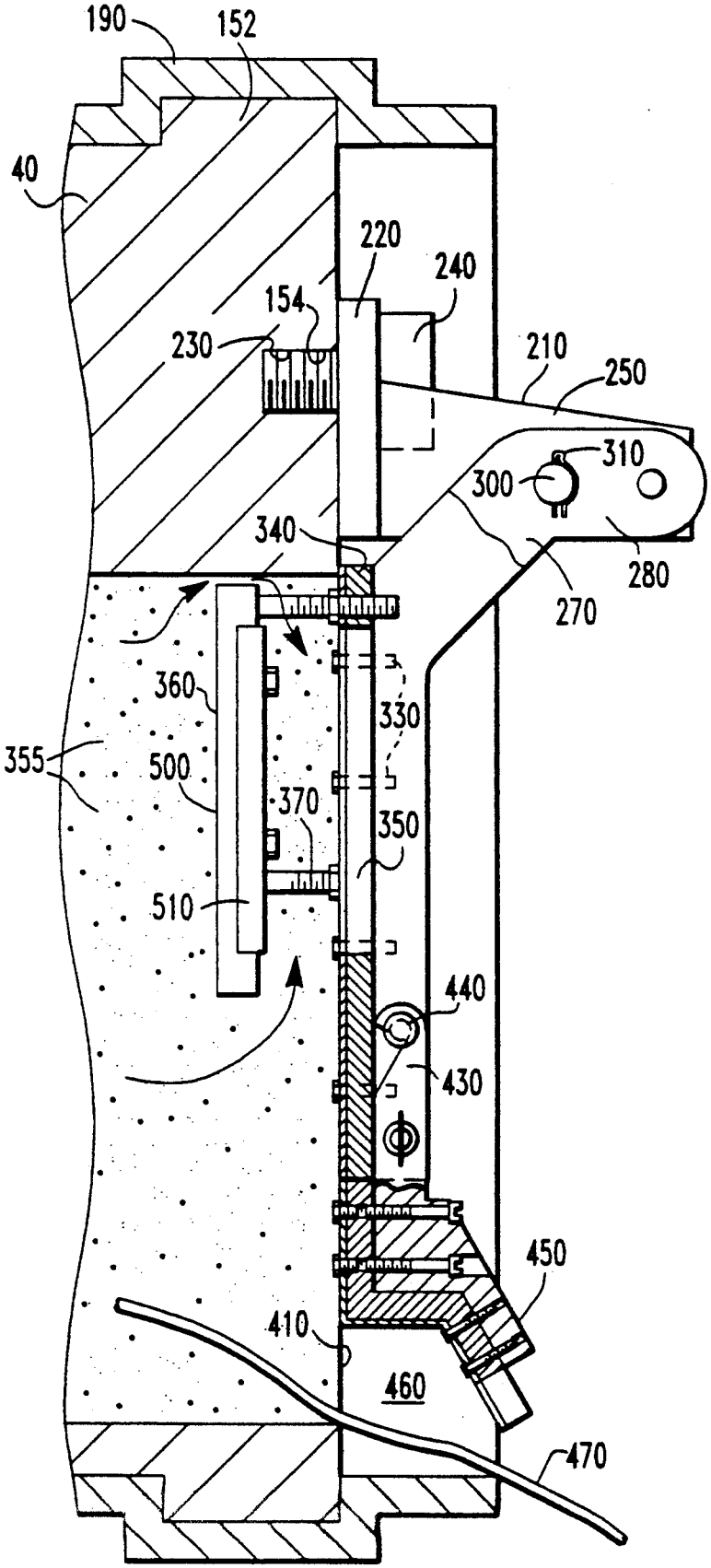
FIG. 3 is a lateral view in vertical section of the access door taken along section line 3—3 of FIG. 2.
Figure 4:
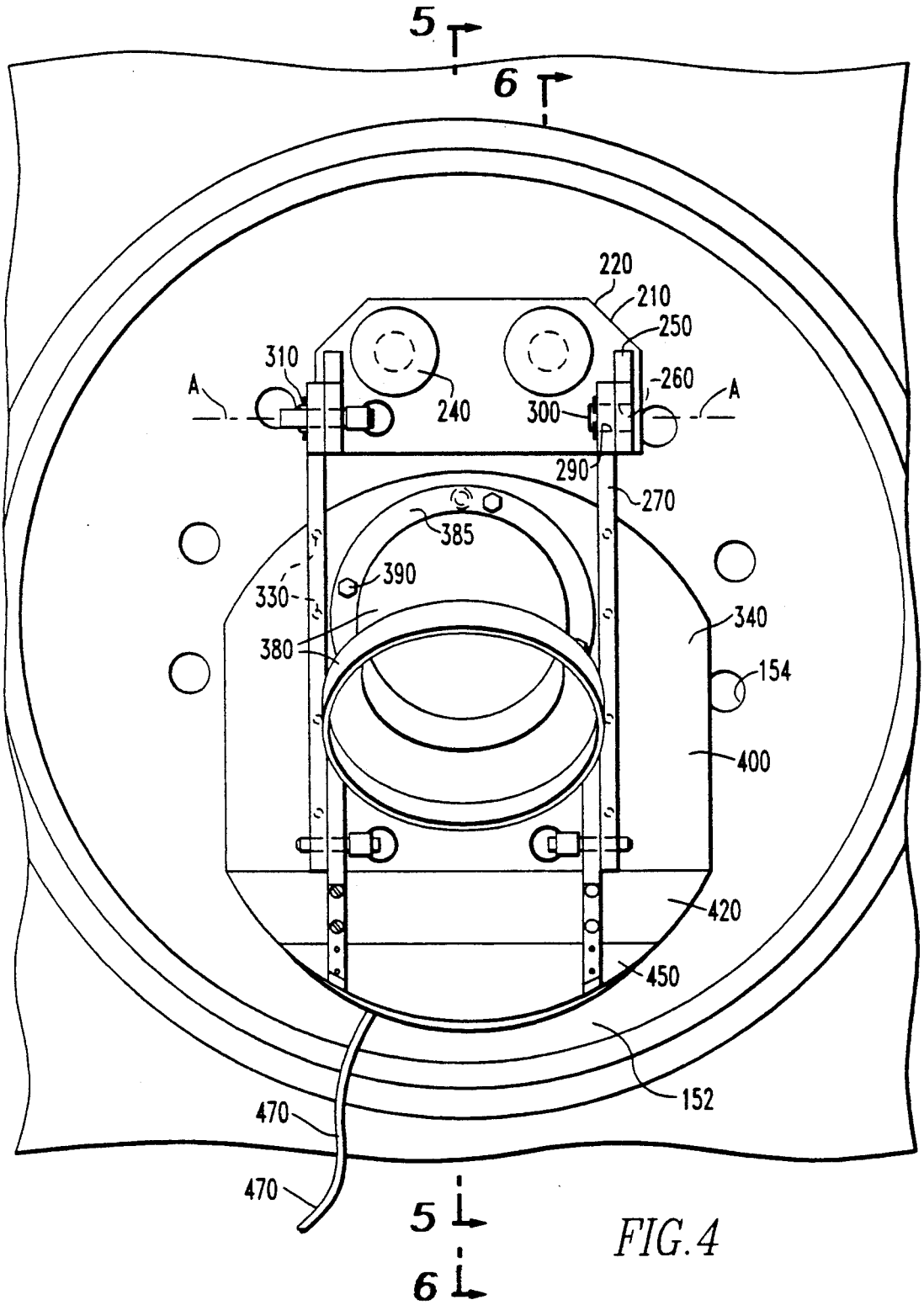
FIG. 4 is a view in elevation of the access door showing a ventilation duct sealingly attached to the hole.
Figure 5:
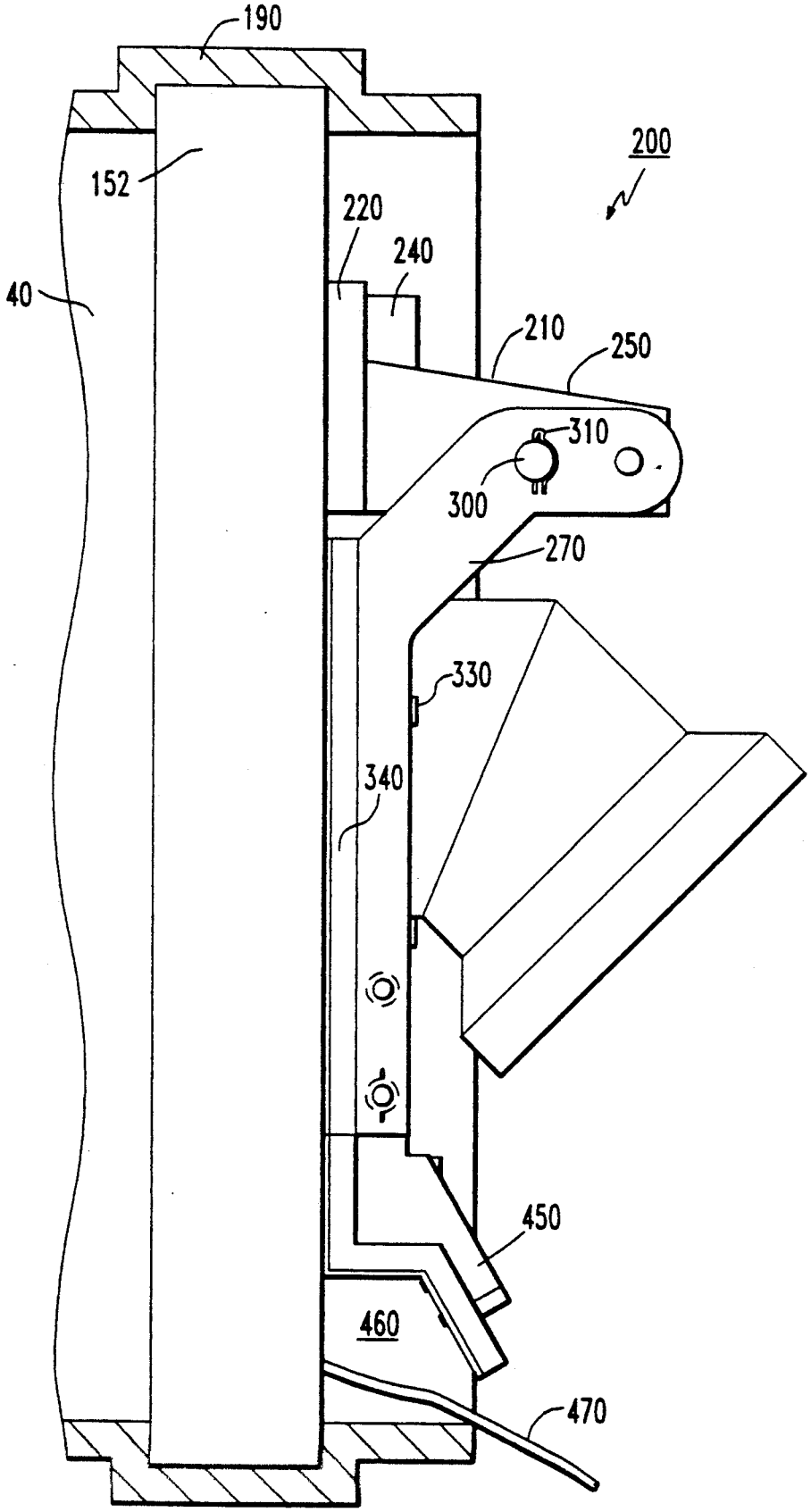
FIG. 5 is a lateral view in elevation of the access door taken along section line 5—5 of FIG. 4.
Figure 6:
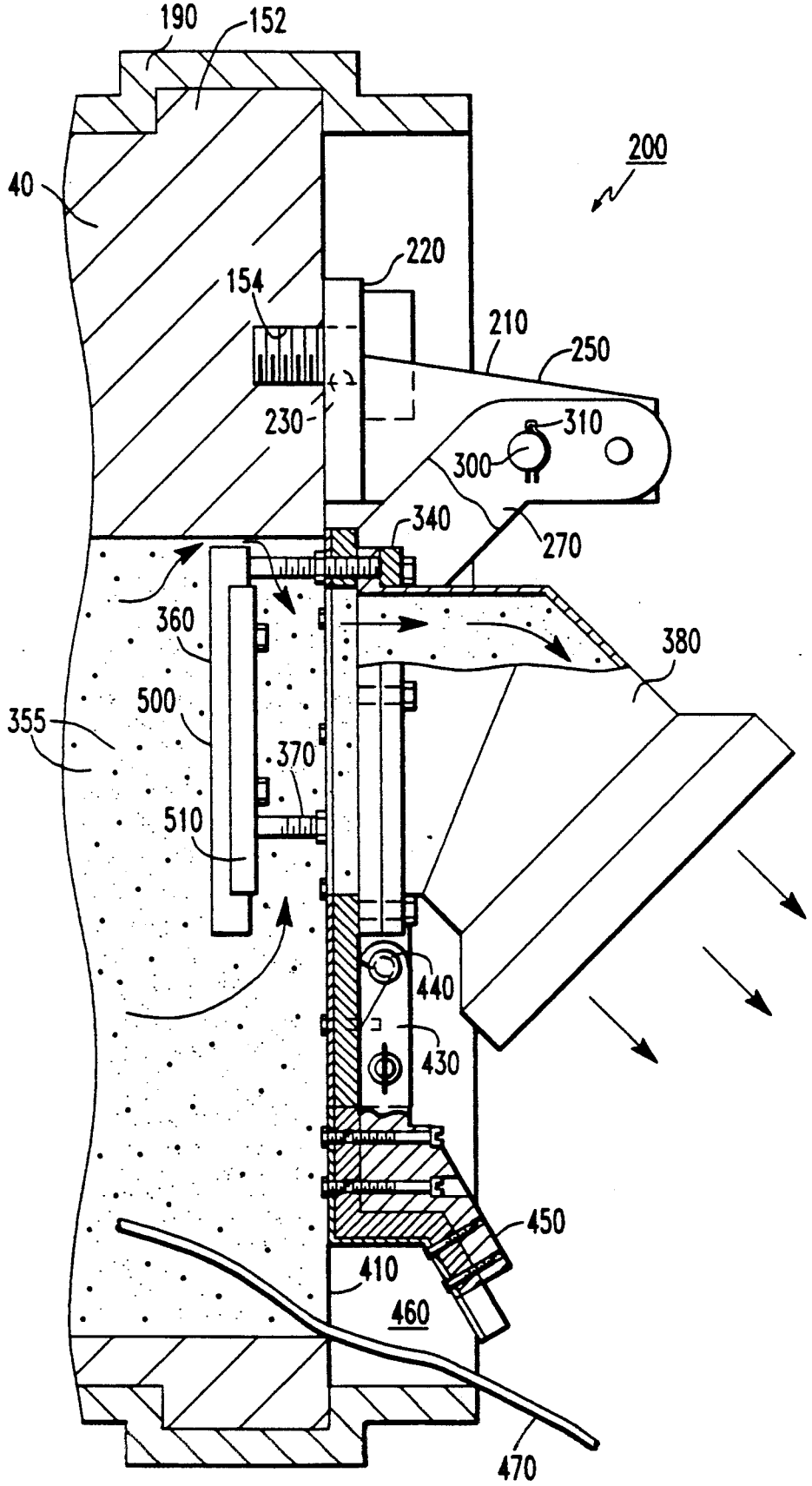
FIG. 6 is a lateral view in partial elevation of the access door taken along section line 6—6 of FIG. 4.

Therefore, referring to FIG. 1, there is shown a typical nuclear steam generator, generally referred to as 10, for generating steam. Steam generator 10 comprises an outer hull 20 having an upper portion 30 and a lower portion 40. Disposed in upper portion 30 is moisture separating means 50 for separating a steam-water mixture (not shown). Disposed in lower portion 50 is an inner hull 60 which is closed at its top end except for a plurality of openings in its top end for allowing passage of the steam-water mixture from inner hull 60 to moisture separating means 50. Disposed in inner hull 60 is a vertical steam generator tube bundle 70 defined by a plurality of vertical inverted U-shaped steam generator tubes 80 that extend through holes formed in a plurality of spaced-apart support plates 90. Disposed in lower portion 40 is a tube sheet 100 having a plurality of apertures therethrough for receiving and supporting the ends of each tube 80. Moreover disposed on outer hull 20 are a first inlet nozzle 110 and a first outlet nozzle 120 in fluid communication with an inlet plenum chamber 130 and with an outlet plenum chamber 140, respectively. A plurality of generally circular manways ports 150 are formed through outer hull 20 below tube sheet 100 for providing access to inlet plenum chamber 130 and outlet plenum chamber 140, so that maintenance can be performed in steam generator 10. Each manway port 150 is surrounded by a circular manway flange 152 having a plurality of internally threaded equally spaced-apart bolt holes 154 therearound (see FIG. 2). Of course, during operation of steam generator 10, manway ports 150 are each sealingly covered by a suitable manway hatch cover (not shown) bolted to manway flange 152.

Still referring to FIG. 1, formed through outer hull 20 above tube bundle 70 is a second inlet nozzle 160, which is connected to a perforated feedring 170 disposed in upper portion 30 for allowing entry of nonradioactive secondary fluid ( not shown) into upper portion 30. The secondary fluid, which is demineralized water, will flow into upper portion 30 through second inlet nozzle 160 and through the perforations of feedring 170. A second outlet nozzle 180 is disposed atop upper portion 30 for exit of the steam from steam generator 10. Moreover, enveloping or surrounding the exterior of steam generator 10 may be a layer of insulation material 190 for reducing heat loss from the exterior surface of steam generator 10.

During operation of steam generator 10, heated radioactive primary fluid, which is demineralized water, enters inlet plenum chamber 130 through first inlet nozzle 110 and flows through tubes 80 to outlet plenum chamber 140 whereupon the primary fluid exits steam generator 10 through first outlet nozzle 120. As the primary fluid enters inlet plenum chamber 130, the secondary fluid simultaneously enters feedring 170 through second inlet nozzle 160 and flows downwardly from the perforations of feedring 170. A portion of this secondary fluid vaporizes into a steam-water mixture due to conductive heat transfer from the primary fluid to the secondary fluid through the walls of tubes 80 which comprise bundle 70. The steam-water mixture flows upwardly from bundle 70 and is separated by moisture separating means 50 into saturated water and dry saturated steam, which dry saturated steam exits steam generator 10 through second outlet nozzle 180. The structure and operation of such a typical nuclear steam generator is more fully described in U.S. Pat. No. 4,079,701 titled "Steam Generator Sludge Removal System" issued Mar. 1, 1978 in the name of Robert A. Hickman, et al., the disclosure of which is hereby incorporated by reference.

Referring now to FIGS. 2, 3, 4, 5 and 6, there is shown the subject matter of the present invention, which is a shielded access door, generally referred to as 200, for manway port 150 of steam generator 10. Access door 200 comprises a bracket 210 including a base plate 220 having a plurality of transverse apertures 230 therethrough for receiving respective ones of a plurality of externally threaded bolts 240, the apertures 230 being coaxially aligned with associated ones of bolt holes 154. Bolts 240 are externally threaded for threadably engaging the internally threaded bolt holes 154 of flange 152. In this manner, base plate 220, and thus bracket 210, are capable of being removably connected to flange 152. Integrally attached to base plate 220 and outwardly perpendicularly extending therefrom are a plurality of parallel elongate wing members 250. Wing members 250 are of a predetermined length, such as greater than six to eight inches, in order to extend beyond insulation 190. The length of wing members 250 is important because such an extended length allows access door 200 to be positioned over port 150 without interfering with insulation 190. This obviates the need to remove a portion of the insulation 190 in order to position access door 200 over port 150. Each wing member 250 has a transverse bore 260 therethrough for reasons disclosed presently. An elongate swing arm 270 is associated with respective ones of the wing members 250, each swing arm 270 having a first end portion 280 thereof pivotally connected to its respective wing member 250. First end portion 280 has a transverse bore 290 therethrough for reasons disclosed presently. In this regard, extending through bore 280 and bore 290, which are coaxially aligned, is a pivot pin 300 secured in bores 280/290 by any convenient means, such as by a suitable hairpin 310. Thus, each swing arm 270 is capable of pivoting about pivot pin 300 which lies on an axis A-A extending perpendicularly through each wing member 250 (i.e., longitudinally through each pivot pin 300). Moreover, each swing arm 270 has a second end portion 320 for reasons disclosed hereinbelow.

Still referring to FIGS. 2, 3, 4, 5 and 6, integrally rigidly attached, such as by a plurality of screws 330, to second the end portion of each swing arm 270 is first shield means, such as a generally circular first shield plate 340. Shield plate 340 is capable of being disposed parallel to and adjacent port 150 for shielding against the beam of radiation streaming through port 150. First shield plate 340 has a generally circular ventilation hole 350 therethrough for ventilating port 150 and thus for ventilating the interior of steam generator 10, so that air-borne radioactive particles 355 can pass from the interior of steam generator 10 through port 150 and through hole 350 as port 150 is ventilated in the manner disclosed more fully hereinbelow. When disposed parallel to port 150, hole 350 allows the beam of radiation to "shine" or stream through it. This is undesirable for health physics reasons. Therefore, coaxially aligned with hole 350 and spaced-apart therefrom is second shield means, such as a generally circular second shield plate 360. Second shield plate 360 is rigidly attached to first shield plate 340, such as by a plurality of screw bolts 370. It will be appreciated from the description hereinabove, that second shield plate 360 is oriented parallel to hole 350 and interposed between hole 350 and the beam of radiation for shielding hole 350 against the beam of radiation so that the beam of radiation does not stream through hole 350. In the preferred embodiment of the invention, second shield plate 360 is disposed inwardly of port 150 in the interior of steam generator 10. Sealingly surrounding hole 350 of first shield plate 340 and outwardly extending therefrom is a generally tubular ventilation duct 380 for ventilating port 150 and thus for ventilating the interior of steam generator 10. As port 150 is ventilated, the air-borne radioactive particles 355 present in the interior of steam generator 10 pass through port 150 and through hole 350 of first shield plate 340 and into the interior of duct 380. When ventilated, the air-borne particles 355 will flow along a path generally illustrated by the arrows in FIG. 6. Moreover, as the interior of steam generator 10 is ventilated, the air therein will flow along the inner diameter of each tube 80 for drying the inner diameter so that inspection probes (not shown) travel along the inner diameter without slippage. Duct 380 may have a sealing flange 385 surrounding an end thereof that is removably sealingly attached to hole 350, such as by screws 390. Duct 380 may be flexible for readily connecting the other end thereof to a suitable vacuum pump (not shown) that draws or suctions the contaminated air through duct 380.

Still referring to FIGS. 2, 3, 4, 5 and 6, in the preferred embodiment of the invention, first shield plate 340 is formed of a plurality of light weight segments. In this regard, a generally arcuate-shaped first segment 400, which may weigh approximately 35 pounds, is attached to second end portion 320 of swing arm 270, the first segment 400 having the hole 350 therethrough. First segment 400 is sized to cover a portion of port 150, so that port 150 has a covered portion and also an uncovered portion 410. Moreover, a generally arcuate-shaped second segment 420, which may weight approximately ten pounds, is removably connected to first segment 400, such as by hook-like fasteners 430 that engage associated pins 440 extending outwardly from first segment 400. Second segment 420 also has an integrally attached outwardly angled skirt portion 450 disposed opposite the uncovered portion 410 of port 150. The angle (e.g., 45 degrees) of skirt portion 450 defines a gap 460 between port 150 and skirt portion 450. It is important that gap 460 be present. This is important because gap 460 is sufficiently large to allow access to port 150 in order to provide space for instrumentation cabling, such as cable 470, and to provide space for passage of appropriate service tooling. Thus, it will be appreciated that first and second segments 400/420 provide shielding while simultaneously providing access to port 150.

Referring yet again to FIGS. 2, 3, 4, 5 and 6, in the preferred embodiment of the invention, first shield plate 340 and second shield plate 360 comprise a plurality of laminated layers, such as a first layer 500, which may be aluminum or the like, integrally attached to a second layer 510, which may be lead or the like. Layer 500 resists accumulation of radioactive particles on shield plates 340/360. In this regard, first layer 500 has a substantially smooth exterior surface that is formed from a material that is resistant to denting/scratching and that may be polished, so that the radioactive particles will not substantially adhere to or accumulate on the surface. It is important that radioactive particles not substantially accumulate on the surface of first layer 500 because such accumulation of the particles increases the effort and expense to remove the particles to decontaminate access door 200 following steam generator maintenance.

OPERATION

In order to perform maintenance on steam generator 10, the steam generator 10 is taken off-line and the secondary and primary fluids are drained therefrom. Next, the manway hatch covers (not shown) are removed from the manway ports 150 to provide access to the interior of steam generator 10. However, after the hatch covers are removed, a beam of radiation "shines" or streams through the manway ports. Use of the invention shields maintenance personnel from the beam of radiation while simultaneously allowing access to the manway port 150 and the interior of steam generator 10. When used as contemplated herein, the access door 200 reduces the radiation level at the manway port 150 from approximately 7,000 mR to approximately 90 mR.

In this regard, bracket 210 is attached to manway flange 152 by passing bolts 240 through apertures 230 and threadably engaging bolts 240 into bolt holes 154. First segment 400 is connected to bracket 210 by connecting each swing arm 270 to its associated wing member 250 by means of pivot pin 300. It is preferred that swing arms 270 are connected to wing members 250 prior to disposing access door over port 150, so that it is not necessary for maintenance personnel to connect swing arms 270 to wing members 250 while standing in the path of the beam of radiation. Second segment 420 is then transported to port 150 and removably connected to first segment 400 by engaging hook-like fastener 430 onto pin 440.

Following maintenance of steam generator 10, access door 200 is removed from port 150 in substantially the reverse order or positioning access door over port 150. After access door 200 is removed from port 150, the manway hatch covers are replaced over manway ports 150 and steam generator 10 is returned to service.

Although the invention is illustrated and described herein, it is not intended that the invention as illustrated ad described be limited to the details shown, because various modifications may be obtained with respect to the invention without departing from the spirit of the invention or the scope of equivalents thereof. For example, rather that swing arms 270 being pivotable on wing members 250, elongate downwardly inclined or canted rail members outwardly projecting from base plate 210 can be substituted for wing members 250. The rail members would be downwardly inclined toward port 150. The swing arms 270 would then slidably engage the rail members so that access door is slidable on the rail members into abutment with flange 152 rather than being pivotable on wing members 250. Thus, access door 200 could be slid into position by force of gravity from a location that is further away from port 150, at which location the radiation exposure is less. Such a rail member and slidable swing arm combination would necessarily place maintenance personnel further away from port 150 for reducing the radiation exposure to the maintenance personnel.

What is claimed is:

1. A shielded access door for a port having a beam of nuclear radiation streaming therethrough, the port surrounded by a flange, comprising:

(a) a bracket adapted to connect to the flange;

(b) first shield means connected to said bracket and disposed adjacent the port for shielding against the beam of radiation, said first shield means having a ventilation hole therethrough for ventilating the port, the beam of radiation capable of passing through the hole, said first shield means including an angled skirt portion for shielding against the beam of radiation while simultaneously allowing access to the port;

(c) second shield means aligned with the hole of said first shield means and spaced-apart from said first shield means for shielding against the beam of radiation, said second shield means attached to said first shield means; and (d) a duct connected to said first shield means and in communication with the hole of said first shield means for ventilating the port.

2. A shielded access door for allowing access to a port having a beam of nuclear radiation streaming therethrough and for shielding against the beam of radiation, the port surrounded by a flange, the door comprising:

(a) a bracket adapted to be removably connected to the flange;

(b) an arm having a first end portion and a second end portion, the first end portion pivotally connected to said bracket;

(c) a first shield member connected to the second end portion of said arm and disposed parallel and adjacent to the port for shielding against the beam of radiation, said first shield member and the port defining a gap therebetween, said first shield member having a ventilation hole therethrough in communication with the port for ventilating the port, the beam of radiation capable of passing through the hole, said first shield member including a plurality of connected segments for shielding against the beam of radiation while simultaneously allowing access to the port, said segments including:

(i) a first segment connected to said arm; and (ii) a second segment connected to said first segment and having an angled skirt portion for shielding against the beam of radiation while simultaneously allowing access to the port;

(d) a second shield member coaxially aligned with the hole of said first shield member and spaced-apart from said first shield member, said second shield member attached to said first shield member, said second shield member capable of being interposed between the beam of radiation and the hole for shielding against the beam of radiation at the hole; and (e) a ventilation duct surrounding the hole of said first shield member and removably connected to said first shield member, said duct in communication with the hole for ventilating the port.

3. On a heat exchanger having an exterior and having an interior having air-borne radioactive particles suspended therein, the interior having a plurality of heat exchange components therein, the heat exchanger having an open manway port in communication with the interior of the heat exchanger for providing access to the components, the port having a beam of radiation streaming therethrough from the interior of the heat exchanger, the port surrounded by a flange on the exterior of the heat exchanger, the flange having an plurality of transverse internally threaded bolt holes therein and spaced-apart therearound, a shielded access door for the port, the door comprising:

(a) a bracket disposed adjacent the port and connected to the flange, said bracket including:

(i) a base plate having a plurality of apertures therethrough coaxially aligned with associated ones of the bolt holes; and (ii) a plurality of parallel elongate wing members integrally attached to said base plate and outwardly extending therefrom;

(b) a plurality of externally threaded bolts received through respective ones of the apertures and threadably engaging respective ones of the bolt holes for removably attaching said bracket to the flange;

(c) a plurality of parallel elongate swing arms associated with respective ones of said wing members, each of said swing arms having a first end portion pivotally connected to its respective wing member, said swing arm capable of pivoting about a pivot point laying on an axis extending perpendicularly through each of said wing members, each of said swing arms having a second end portion;

(d) a generally circular first shield plate rigidly connected to the second end portions of said swing arms and disposed parallel and adjacent to the port for shielding against the beam of radiation, said first shield plate having a generally circular ventilation hole therethrough in communication with the port for ventilating the port, so that the air-borne radioactive particles pass through the port and through the hole as the port is ventilated, the beam of radiation capable of passing through the hole; and (e) a generally circular second shield plate coaxially aligned with the hole of said first shield plate and spaced-apart from said first shield plate, said second shield plate rigidly attached to said first shield plate, said second shield plate interposed between the port and the beam of radiation for shielding the hole against the beam of radiation.

4. The door of claim 3, wherein said first shield plate is formed of a plurality of connected segments for shielding against the beam of radiation while simultaneously allowing access to the port, said segments comprising:

(a) a generally arcuate-shaped first segment attached to the second end portions of said swing arms, said first segment sized to cover a portion of the port, so that the port has a covered portion and an uncovered portion; and (b) a generally arcuate-shaped second segment removably connected to said first segment and having an angled skirt portion, said second segment disposed opposite the uncovered portion of the port and defining a gap between said second segment and the uncovered portion of the port for shielding against the beam of radiation while simultaneously allowing access to the port through the gap.

5. The door of claim 4, further comprising a generally tubular ventilation duct sealingly surrounding the hole of said first shield plate and removably connected to said first shield plate, said duct having an interior in communication with the port for ventilating the port, so that the air-borne radioactive particles pass through the port and through the hole of said first shield plate and into the interior of said duct as the port is ventilated.

6. The door of claim 5, wherein said first shield plate and said second shield plate are each formed of a material opaque to the beam of radiation for shielding against the beam of radiation.

7. The door of claim 6, wherein said first shield plate and said second shield plate each comprises a plurality of laminated layers for resisting accumulation of the radioactive particles thereon while simultaneously shielding against the beam of radiation.

8. The door of claim 7, wherein said layers are a first layer having a smooth exterior surface normal to the beam of radiation, the surface resistant to accumulation of radioactive particles, so that said first and second shield plate are easily decontaminatable, and a second layer coaxially aligned with and attached to said first layer, so that said first and second shield plates shield against the beam of radiation.

9. The door of claim 8, wherein said first layer is aluminum for resisting denting to reduce accumulation of the radioactive particles thereon.

10. The door of claim 9, wherein said second layer is lead for shielding against the beam of radiation.

* * * * *